US011402797B2

(12) United States Patent
Fan

(10) Patent No.: US 11,402,797 B2
(45) Date of Patent: Aug. 2, 2022

(54) PROCESS CARTRIDGE

(71) Applicant: ZHUHAI UN-TERN IMAGING PRODUCTS CO., LTD, Zhuhai (CN)

(72) Inventor: Wenyi Fan, Zhuhai (CN)

(73) Assignee: ZHUHAI UN-TERN IMAGING PRODUCTS CO., LTD, Zhuhai (CN)

( * ) Notice: Subject to any disclaimer, the term of this patent is extended or adjusted under 35 U.S.C. 154(b) by 0 days.

(21) Appl. No.: 17/266,007

(22) PCT Filed: Aug. 2, 2019

(86) PCT No.: PCT/CN2019/098965
§ 371 (c)(1),
(2) Date: Feb. 4, 2021

(87) PCT Pub. No.: WO2020/029870
PCT Pub. Date: Feb. 13, 2020

(65) Prior Publication Data

US 2021/0165363 A1 Jun. 3, 2021

(30) Foreign Application Priority Data

Aug. 7, 2018 (CN) ..... 201821271406.3

(51) Int. Cl.
*G03G 21/18* (2006.01)
*G03G 21/16* (2006.01)

(52) U.S. Cl.
CPC ..... *G03G 21/186* (2013.01); *G03G 21/1647* (2013.01); *G03G 21/1864* (2013.01); *G03G 2221/1657* (2013.01)

(58) Field of Classification Search
CPC ..... G03G 21/1857; G03G 21/186; G03G 15/757; G03G 21/1842; G03G 2221/1657; G03G 21/1647
See application file for complete search history.

(56) References Cited

U.S. PATENT DOCUMENTS 5,436,699 A * 7/1995 Komaki ..... G03G 15/751 399/159
6,070,030 A 5/2000 Fujishiro
(Continued)

FOREIGN PATENT DOCUMENTS

CN 201007783 Y 1/2008
CN 103809420 A 5/2014
(Continued)

OTHER PUBLICATIONS

International Search Report dated dated Oct. 30, 2019 on PCT/CN2019/09865.

*Primary Examiner* — Jessica L Eley
(74) *Attorney, Agent, or Firm* — Franklin & Associates International Inc; Matthew F. Lasabrinos

(57) ABSTRACT

A process cartridge removably disposed in an imaging device provided with a rotational force output head. The process cartridge (100) includes a cartridge body, a rotation component having a rotation axis L1, and a driving force receiving assembly. The driving force receiving assembly is disposed at an end of the cartridge body, and includes a rotational force receiving member and a position adjusting mechanism. The rotational force receiving member is provided with a rotational force receiving portion, a connection portion, and a rotational force transmitting portion. The position adjusting mechanism enables the rotational force receiving member to rotate in a preset direction.

14 Claims, 10 Drawing Sheets

(56) References Cited

U.S. PATENT DOCUMENTS

| | | | | |
|---|---|---|---|---|
| 10,241,459 | B1 * | 3/2019 | Hu | G03G 15/0806 |
| 2014/0300046 | A1 * | 10/2014 | Piening | B65H 7/18 271/117 |
| 2015/0030353 | A1 * | 1/2015 | Wang | F16D 3/06 399/167 |
| 2017/0343951 | A1 * | 11/2017 | Gist | G03G 15/757 |

FOREIGN PATENT DOCUMENTS

| | | | |
|---|---|---|---|
| CN | 108333901 | A | 7/2018 |
| CN | 109001966 | A | 12/2018 |
| CN | 209103106 | U | 7/2019 |
| JP | 07121088 | A | 5/1995 |

* cited by examiner

PROCESS CARTRIDGE

CROSS REFERENCE TO RELATED APPLICATIONS

This application is a national stage application, filed under 35 U.S.C. § 371, of international patent application PCT/CN2019/098965, entitled "PROCESS CARTRIDGE" filed on Aug. 2, 2019, which claims all benefits accruing under 35 U.S.C. § 119 from China Patent Application No. 201821271406.3, filed on Aug. 7, 2018 in the China National Intellectual Property Administration, the entire content of each of which is hereby incorporated by reference.

TECHNICAL FIELD

The present disclosure relates to a new process cartridge for an imaging device.

BACKGROUND

An electrophotographic imaging device can be, for example, a photocopier, a printer, a fax machine, an integrated machine, or the like. Generally, this type of imaging device has a chamber for installing a process cartridge, and the process cartridge is detachably installed in the chamber of this type of imaging device. After the process cartridge is installed in the chamber of the imaging device, the process cartridge elastically abuts against the chamber of the imaging device in at least two directions, for example, in an installation direction or in a direction perpendicular to the installation direction, thus enabling the process cartridge to move in a certain space during installation or detachment. A rotational force output head is further provided in the imaging device.

In an imaging device in the prior art, the rotational force output head is roughly cylindrical and can rotate around a rotation axis thereof, and two output protrusions are symmetrically arranged at positions perpendicular to the rotation axis. A driving force receiving assembly is disposed at an end of the process cartridge which fits the imaging device. The driving force receiving assembly is provided with a rotational force receiving portion, and the rotational force receiving portion is provided with protruding claws coupled with the output protrusions disposed at one side of the rotational force output head. Generally, in the removal direction of the process cartridge, there is an interference distance of a partial overlap of the protruding claws of the rotational force receiving portion and the output protrusions of the rotational force output head, which will cause certain interference during the installation or the detachment of the process cartridge. In the prior art, a manufacturer of HP or CANON adopts a driving force receiving assembly with a universal joint structure, which enables the process cartridge to be separated from the rotational force output head without interference during detachment, but the manufacture cost is relatively high. In addition, some manufacturers adopt a driving force receiving assembly stretchable axially, or a driving force receiving assembly with a cross slide groove. However, in these two manners, at some positions with certain angles, the driving force receiving assembly may be obstructed by the rotational force output head disposed on a side proximate to the imaging device, thus making it difficult to remove the process cartridge. If the process cartridge is taken out forcibly, the coupled portions of the driving force receiving assembly and the rotational force output head will wear or be damaged, thus seriously affecting service lives of the process cartridge and imaging device.

SUMMARY

The technical problem to be solved by the present disclosure is to provide a process cartridge capable of avoiding or reducing interference between a driving force receiving assembly and a rotational force output head during detachment.

In order to solve the technical problem above, the present disclosure provides a process cartridge removably disposed in an imaging device. The imaging device is provided with a rotational force output head, and the process cartridge includes: a cartridge body; a rotation component having a rotation axis; a driving force receiving assembly disposed at an end of the cartridge body. The driving force receiving assembly includes: a rotational force receiving member, provided with a rotational force receiving portion, a connecting portion and a rotational force transmitting portion; a position adjusting mechanism enabling the rotational force receiving member to rotate to a preset position.

In the process cartridge with the above-mentioned structure, the position adjusting mechanism enables the rotational force receiving member to rotate towards a preset position and arrive at the preset position. When the rotational force receiving member is located at the preset position, in the removal direction of the process cartridge, basically, there is no interference between the rotational force receiving portion of the rotational force receiving member and the rotational force output head of the imaging device. When the process cartridge stops working, if the rotational force output head is located at the preset position, the position adjusting mechanism enables the rotational force receiving member to rotate towards the preset position and arrive at a position closest to the preset position. In this case, there will be interference between the rotational force receiving portion of the rotational force receiving member and the rotational force output head of the imaging device, however the interference force is small, and the rotational force receiving portion and the rotational force output head will not be damaged or worn. There is no need to arrange a universal joint structure for the process cartridge with such a structure, and the process cartridge can be removed from the imaging device directly without axial extension and retraction, nor vertical translation of the driving force receiving assembly, thereby simplifying a removal operation.

In some embodiments, the position adjusting mechanism includes: a driven member disposed on the connecting portion of the rotational force receiving member; an operating assembly configured to exert a force on the driven member and force the rotational force receiving member to rotate to the preset position.

In the process cartridge with the above structure, the operating component exerts a rotational force to the rotational force receiving member, so that the rotational force receiving member can rotate to the preset position, thereby facilitating the removal of the process cartridge.

In some embodiments, the driven member includes at least one rib disposed on the connecting portion, and the rib has a first contact surface and an arc-shaped second contact surface.

In the process cartridge with the above structure, the rib receives the rotational force. The structure of the rib is simple.

In some embodiments, the operating assembly includes a cylindrical member sleeved over an outer side of the rotational force receiving member; at least one bracket is provided on an inner side wall of the cylindrical member; and at least one force receiving part is provided on an outer side wall of the cylindrical member.

In the process cartridge with the above structure, the rotational force can be transmitted to the rotational force receiving member by means of the arranged cylindrical member.

In some embodiments, the bracket is an elastic arm extending from the inner side wall of the cylindrical member in a radial direction towards an axis of the cylindrical member; a free end of the bracket has a first end surface capable of abutting against the first contact surface and a second end surface capable of being in a sliding contact with the second contact surface.

In the process cartridge with the above structure, when the cylindrical member receives the rotational force that forces the rotational force receiving member to rotate to the preset position, the cylindrical member rotates and abuts the first contact surface by means of the first end surface, thus transmitting the rotational force to the rotational force receiving member, and forcing the rotational force receiving member to rotate to the preset position.

In some embodiments, the operating assembly further includes a force exerting member, and the force exerting member is configured to exert a rotational force on the force receiving part to force the cylindrical member to rotate.

In some embodiments, the driving force receiving assembly further includes a push rod, and the force exerting member is arranged at an end of the push rod.

In some embodiments, the force receiving part includes at least one first protrusion or first groove provided on an outer circumferential wall of the cylindrical member; and the force exerting member includes a second groove meshing with the first protrusion, or a second protrusion meshing with the first groove.

In some embodiments, the force receiving part and the force exerting member are both tooth-shaped and capable of meshing with each other.

In some embodiments, the imaging device is provided with a door cover, and when the door cover is opened, the position adjusting mechanism enables the rotational force receiving member to rotate to the preset position.

In some embodiments, the process cartridge further includes: an end cover disposed at an end of the cartridge body; a hub arranged at an end of the rotation component, the hub having a chamber provided with a first protruding part therein; and a bearing plate disposed at the end of the cartridge body. A first protruding pillar and a second protruding pillar are disposed on a side of the bearing plate facing the hub, and the rotational force receiving member is capable of passing through a bearing orifice of the bearing plate and being coupled with the rotational force output head.

In some embodiments, the rotation component is a photosensitive drum or a developing roller.

In some embodiments, the driving force receiving assembly further includes: a first coil spring sleeved on the push rod to exert an elastic force on the push rod; a clutch component including a clutch slide block, a clutch transmission member, and a second coil spring, where the second coil spring is disposed between the clutch transmission member and the hub; and two biasing springs arranged on the first protruding pillar and the second protruding pillar respectively. A first free end of each biasing spring is pressed against a side surface of the rotational force receiving member; a second free end of one biasing spring is pressed against the first protruding pillar, and a second free end of another biasing spring is pressed against the second protruding pillar.

In some embodiments, the bearing plate defines at least one second through orifice; the clutch slide block is provided with at least one second protruding block; the second protruding block is provided with a sloping surface; the second protruding block is capable of passing through the second through orifice; the push rod is provided with a first protruding block and a force receiving surface, and the first protruding block is capable of abutting against the sloping surface; the end cover defines a first through orifice; an end of the push rod is capable of passing through the first through orifice and moving relative to the first through orifice.

In some embodiments, the clutch transmission member is further provided with a second protruding part, and the second protruding part meshes with the first protruding part of the hub in an L1-axis direction to transmit a rotational force to the hub.

The process cartridge of the present disclosure has advantages of convenient and quick detachment operation and low manufacturing cost, etc. The present disclosure effectively solves the problem that the process cartridge is difficult to remove due to the rotational force output head located at some angle positions, and ensures that, when the imaging device stops working, and wherever the rotational force output head is located, the process cartridge can avoid the interference of the rotational force output head, and then be detached smoothly.

The specific embodiments of the present disclosure will be further described in detail hereafter with reference to the accompanying drawings.

DETAILED DESCRIPTION OF THE PREFERRED EMBODIMENTS

First Embodiment

Figure 1:
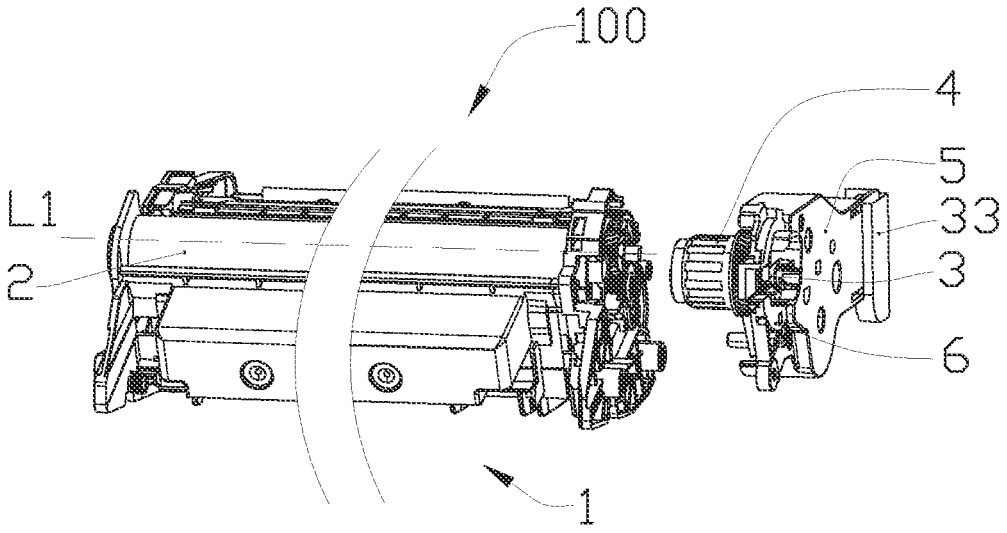
FIG. 1 is a schematic structural diagram of a process cartridge of a first embodiment.
Figure 3:
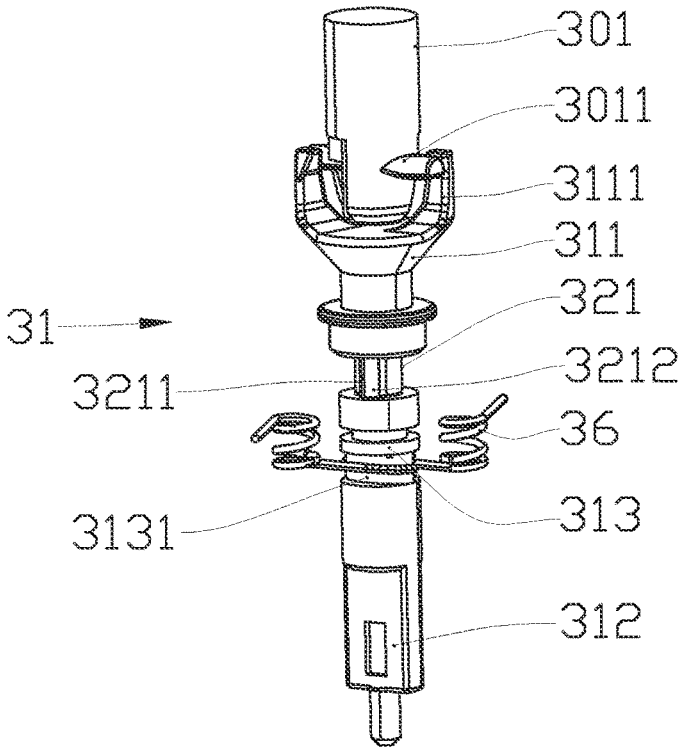
FIG. 3 is a schematic structural diagram of a rotational force receiving member, a rotational force output head, and a biasing spring of the process cartridge of the first embodiment.

As shown in FIGS. 1 and 3, a process cartridge 100 includes a cartridge body 1. Rotation components such as a photosensitive drum 2, a charging roller (not shown), a developing roller (not shown), and a powder feeding roller (not shown) are disposed in the cartridge body 1. In this embodiment, the photosensitive drum 2 can rotate around its own rotation axis L1. Parts of the process cartridge 100 of this embodiment, which are identical with those of the process cartridge in the prior art, are omitted for brevity, and the following description is mainly directed to parts of the process cartridge 100 of this embodiment different from those of the process cartridge in the prior art. A driving force receiving assembly 3, a hub 4, an end cover 5, and a bearing plate 6 are further arranged at an end of the cartridge body 1. The driving force receiving assembly 3 can receive a driving force from a rotational force output head 301 in an imaging device, and transmits the driving force to a rotation component such as the photosensitive drum 2, thus forcing the rotation component to rotate. The hub 4 is arranged at an end of the photosensitive drum 2 and coaxial with the photosensitive drum 2.

Referring to FIGS. 2 to 4, and FIG. 7, the driving force receiving assembly 3 includes a rotational force receiving member 31, a position adjusting mechanism 32, a push rod 33, a first coil spring 34, a clutch component 35, and a biasing spring 36. The rotational force receiving member 31 is provided with a rotational force receiving portion 311, a rotational force transmitting portion 312 and a connecting portion 313.

The rotational force receiving portion 311 is disposed at an end of the rotational force receiving member 31, and two protruding claws 3111 are symmetrically disposed at an end of the rotational force receiving portion 311. The protruding claws 3111 can be coupled with output protrusions 3011 of the rotational force output head 301 of the imaging device 300, so as to receive the rotational force from the imaging device 300. The rotational force transmitting portion 312 is coupled with the clutch component 35, so as to transmit the rotational force to the photosensitive drum. A part of the rotational force transmitting portion 312 has a flat cuboid structure. The connecting portion 313 is disposed between the rotational force receiving portion 311 and the rotational force transmitting portion 312, and configured to connect the rotational force receiving portion 311 and the rotational force transmitting portion 312, on which an elliptical supporting member 3131 is arranged.

The position adjusting mechanism 32 includes a driven member 321, a cylindrical member 322, and a force exerting member 331. The cylindrical member 322 and the force exerting member 331 constitute an operating assembly of the position adjusting mechanism 32 of this embodiment. In this embodiment, the driven member 321 includes a rib disposed on a circumferential outer wall of the connecting portion 313 of the rotational force receiving member 31, and in this embodiment, two ribs are provided. Each rib has a first contact surface 3211 and an arc-shaped second contact surface 3212. The cylindrical member 322 is sleeved over an outer side of the connecting portion 313 of the rotational force receiving member 31. After being installed, the driven member 321 is located inside the cylindrical member 322. An arc-shaped bracket 3221 is disposed on the inner side wall of the cylindrical member 322. In this embodiment, the bracket 3221 is an elastic arm extending from the inner wall of the cylindrical member 322 in a radial direction towards the axis of the cylindrical member 322. A free end of the bracket 3221 has a first end surface 32211 capable of abutting against the first contact surface 3211 and a second end surface 32212 capable of being in a sliding contact with the second contact surface 3212. A force receiving part 3222 is provided on the circumferential outer wall of the cylindrical member 322. The force receiving part 3222 may include one or more first grooves, or one or more first protrusions. In this embodiment, the force receiving part 3222 is tooth-shaped, and distributed along a circumferential direction on a whole circle of or partial circle of the outer wall of the cylindrical member 322. In this embodiment, the force receiving member is only arranged along the circumferential direction on the partial circle.

Referring to FIG. 1, FIG. 2, FIG. 4, FIG. 5, and FIG. 7, the push rod 33 is disposed at an end of the cartridge body, and located at an inner side of the end cover 5, and a length direction of the push rod is perpendicular to the axis L1 of the photosensitive drum 2. The end cover 5 defines a first through orifice 51, and an end of the push rod 33 in the length direction can pass through the first through orifice 51. The force exerting member 331 is arranged at an end of the push rod 33, which is proximate to the rotational force receiving member 31, and includes second protrusions or second grooves that can mesh with the force receiving part 3222. In this embodiment, the force exerting member 331 is tooth-shaped and meshes with the force receiving part 3222. The push rod 33 is further provided with a force receiving surface 332 and a first protruding block 333. The force receiving surface 332 is disposed on an outer side of the end cover 5 in the direction perpendicular to the axis L1 of the photosensitive drum 2, and configured to receive an external pushing force. In this embodiment, the external pushing force comes from a pressing block 3021 of the door cover 302 of the imaging device 300. When the door cover 302 of the imaging device 300 is closed, the pressing block 3021 of the door cover 302 presses the force receiving surface 332, forcing the push rod 33 to move in a W direction relative to the first through orifice 51. The first coil spring 34 is sleeved over the push rod 33. An end of the first coil spring 34 is pressed against the push rod 33, and another end is pressed against the end cover 5. The first coil spring 34 can exert elastic forces on the push rod 33. When the door cover 302 of the imaging device is opened, the push rod 33 loses the external pushing force. Under the elastic force of the first coil spring 34, the push rod 33 moves in a direction opposite to the W direction to an initial position. When the push rod 33 moves in the W direction, the force exerting member 331 can exert a rotational force on the force receiving part 3222, thus forcing the cylindrical member 322 to rotate in an a direction for a certain angle. In this case, when the end of the bracket 3221 touches the driven member 321, the second end surface 32212 of the bracket 3221 is in a sliding contact with the second contact surface 3212 of the driven member 321, and simultaneously, the second contact surface 3212 presses against the second end surface 32212, thus forcing the bracket 3221 to elastically deform, so that the second end surface 32212 slides over the second contact surface 3212. At this time, even if the cylindrical member 322 rotates, the rotational force receiving member 31 does not rotate. When the push rod 33 moves in the direction opposite to the W direction under the elastic force of the first coil spring 34, the cylindrical member 322 rotates in a direction opposite to the a direction, and the first end surface 32211 of the bracket 3221 abuts against the first contact surface 3211 of the driven member 321. The rotation of the cylindrical member 322 drives the rotational force receiving member 31 to rotate in the direction opposite to the a direction to a preset position.

Figure 2:
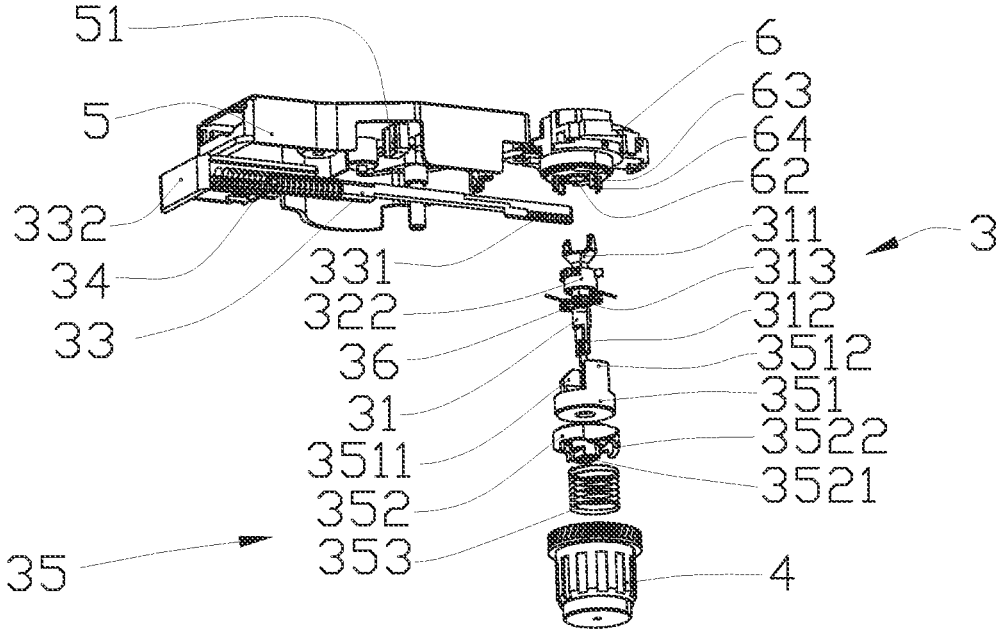
FIG. 2 is a schematic assembly diagram of a driving force receiving assembly, an end cover, a bearing plate, and a hub of the process cartridge of the first embodiment.
Figure 6:
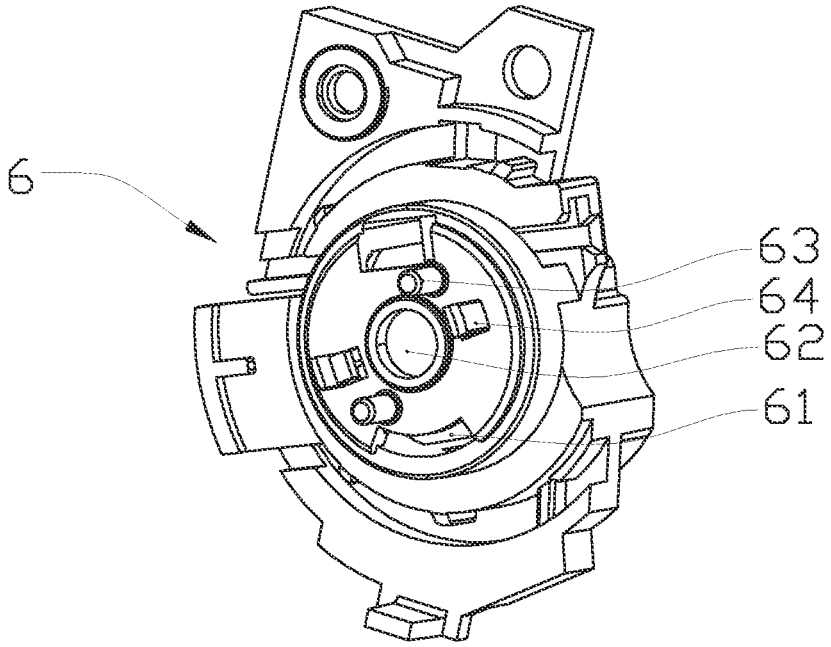
FIG. 6 is a schematic structural diagram of a bearing plate of the first embodiment.

Referring to FIG. 2 and FIG. 6, the bearing plate 6 defines a second through orifice 61 and a bearing orifice 62, and is provided with a first protruding pillar 63 and a second protruding pillar 64 on a side proximate to the hub 4.

As shown in FIG. 2, FIG. 3, FIG. 4, FIG. 6, and FIG. 8*b*, two biasing springs 36 are arranged on the first protruding pillar 63 and the second protruding pillar 64 of the bearing plate 6, respectively. Each biasing spring 36 has two free ends; a first free end is pressed against a side surface of the supporting member 3131 of the rotational force receiving member 31, and a second free end is pressed against the first protruding pillar 63 or the second protruding pillar 64 of the bearing plate 6. When the process cartridge is in a non-working state, the first free end of the biasing spring 36 exerts an elastic force on the side surface of the elliptical supporting member 3131 of the rotational force receiving member 31. The rotational force receiving member 31 rotates to an off-line position due to a torque, thereby achieving an effect of assisting the position adjusting mechanism 32 in positioning.

Figure 8A:
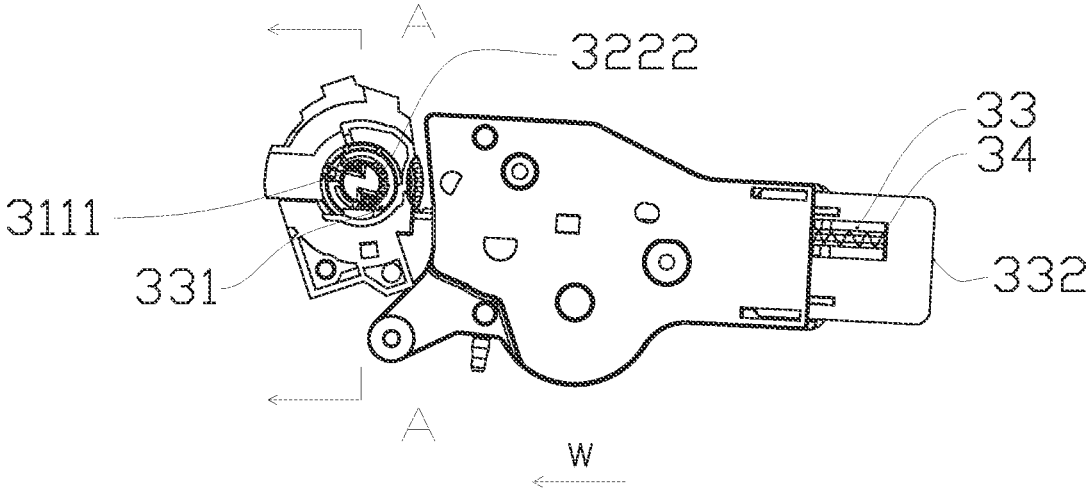
FIG. 8*a* is a side view of the process cartridge in a state where the push rod of the process cartridge of the first embodiment is not pushed by an external force.
Figure 8B:
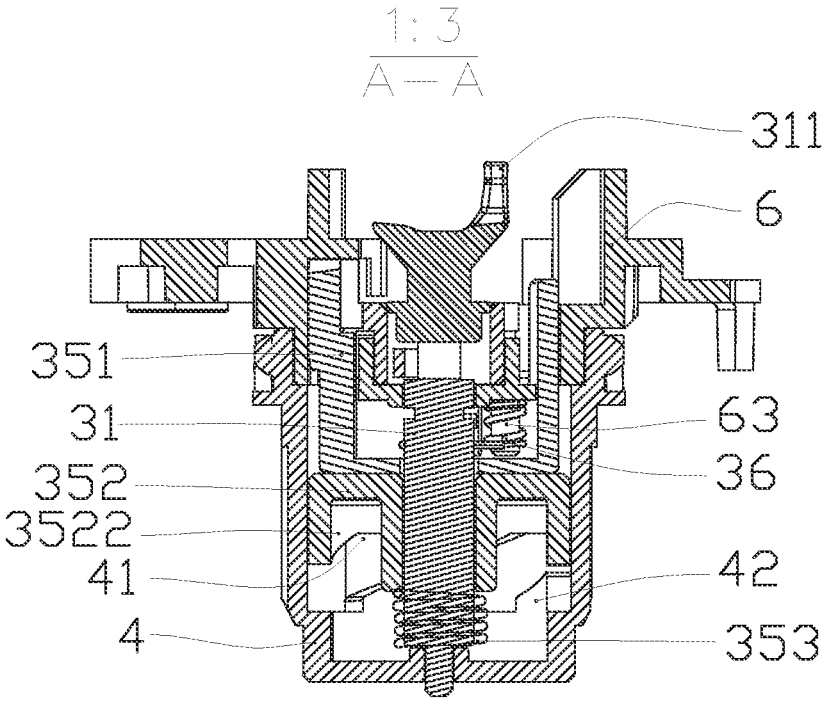
FIG. 8*b* is a cross-sectional view along a direction A-A shown in FIG. 8*a;*

Referring to FIG. 8*b*, the hub 4 has a chamber 41, and a bottom of the chamber 41 is provided with a first protruding part 42 with a sloping surface extending towards the bearing plate 6 along the axis L1.

With reference to FIG. 2, FIG. 5, FIG. 6, FIG. 8*a*, and FIG. 8*b*, the clutch component 35 includes a clutch slide block 351, a clutch transmission member 352, and a second coil spring 353. The clutch transmission member 352 is installed and arranged inside the chamber 41 of the hub 4, and coaxial with the hub 4 and the photosensitive drum. The clutch transmission member 352 defines a third through orifice 3521 allowing the rotational force transmitting portion 312 to pass, and is provided with a second protruding part 3522 that can mesh with the first protruding part 42 of the hub 4 in an L1-axis direction. When the second protruding part 3522 and the first protruding part 42 of the hub 4 mesh with each other in the L1-axis direction, when rotating, the clutch transmission member 352 can transmit the rotational force to the hub 4. The second coil spring 353 is disposed between the clutch transmission member 352 and the hub 4, and can exert an elastic force on the clutch transmission member 352 in the L1-axis direction. A second protruding block 3511 and a third protruding block 3512 are disposed at an end of the clutch slide block 351, which is proximate to the bearing plate 6 in the L1-axis direction. The second protruding block 3511 and the third protruding block 3512 are arranged to pass through the two second through orifices 61 of the bearing plate 6 respectively, so that the clutch slide block 351 can reciprocate along the L1-axis direction. The second protruding block 3511 is provided with a sloping surface 35111, and the sloping surface 35111 can abut against the first protruding block 333. When the force receiving surface 332 of the push rod 33 moves in the W direction under an external force, the first protruding block 333 on the push rod 33 presses the sloping surface 35111, thus forcing the clutch slide block 351 to move towards the hub 4 in the L1-axis direction; simultaneously the clutch transmission member 352 is pressed, thus forcing the clutch transmission member 352 to move towards the hub 4 along the L1-axis direction, and making the second protruding part 3522 of the clutch transmission member 352 mesh with the first protruding part 42 of the hub 4. Now when the rotational force receiving member 31 rotates, the rotational force can be transmitted by the clutch component 35 to the hub 4, and then to the photosensitive drum. When the external force exerted on the force receiving surface 332 disappears, the push rod 33, under the elastic force of the first coil spring 34, moves in the direction opposite to the W direction, and the first protruding block 333 on the push rod 33 no longer presses the sloping surface 35111 of the clutch slide block 351, thus making the clutch slide block 351 not press the clutch transmission member 352 any longer. Under the elastic force of the second coil spring 353, the second protruding part 3522 of the clutch transmission member 352 is separated from the first protruding part 42 on the hub 4. Now when the rotational force receiving member 31 rotates, the hub 4 does not rotate.

Figure 7:
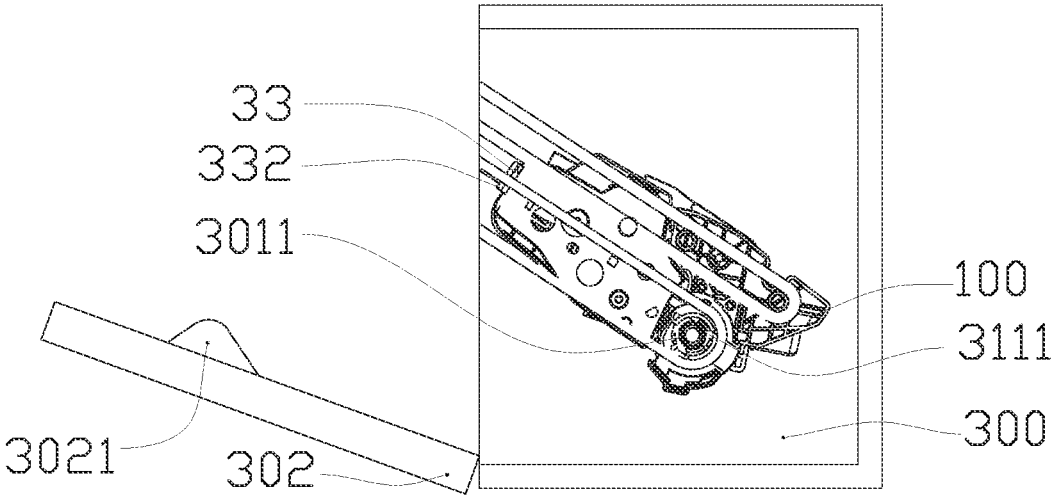
FIG. 7 is a schematic structural diagram illustrating an imaging device and the process cartridge when the imaging device has been installed in the process cartridge of the first embodiment but a door cover of the device is not closed.
Figure 9:
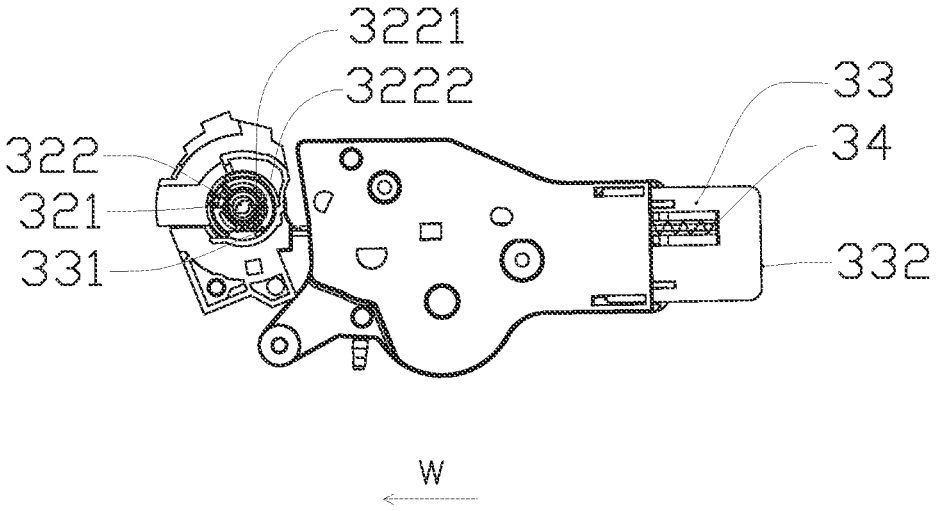
FIG. 9 is a schematic partial structural diagram of the process cartridge in a state where the push rod of the process cartridge of the first embodiment is not pushed by an external force.
Figure 10:
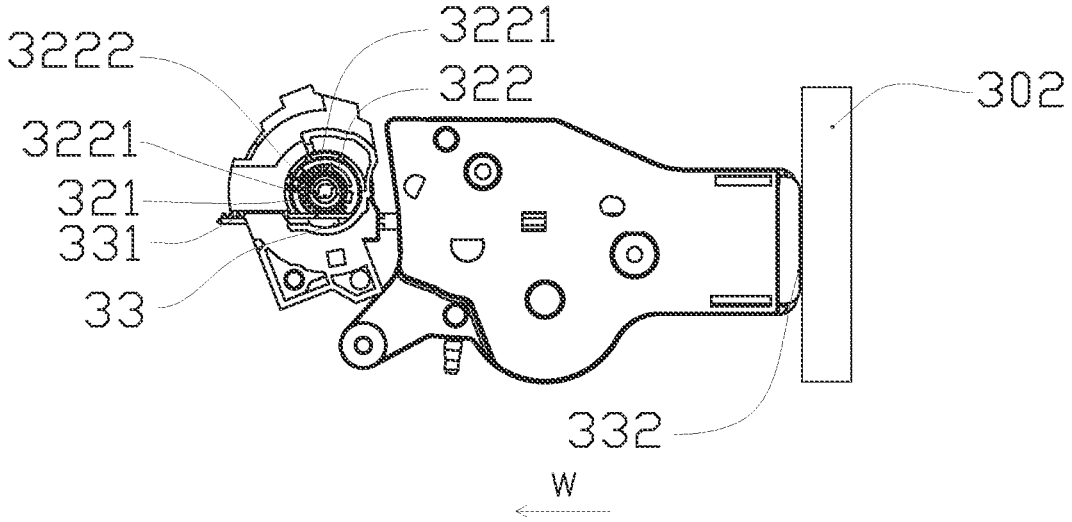
FIG. 10 is a schematic partial structural diagram of the process cartridge when a force receiving surface of the push rod of the process cartridge of the first embodiment is pressed by the door cover.
Figure 11:
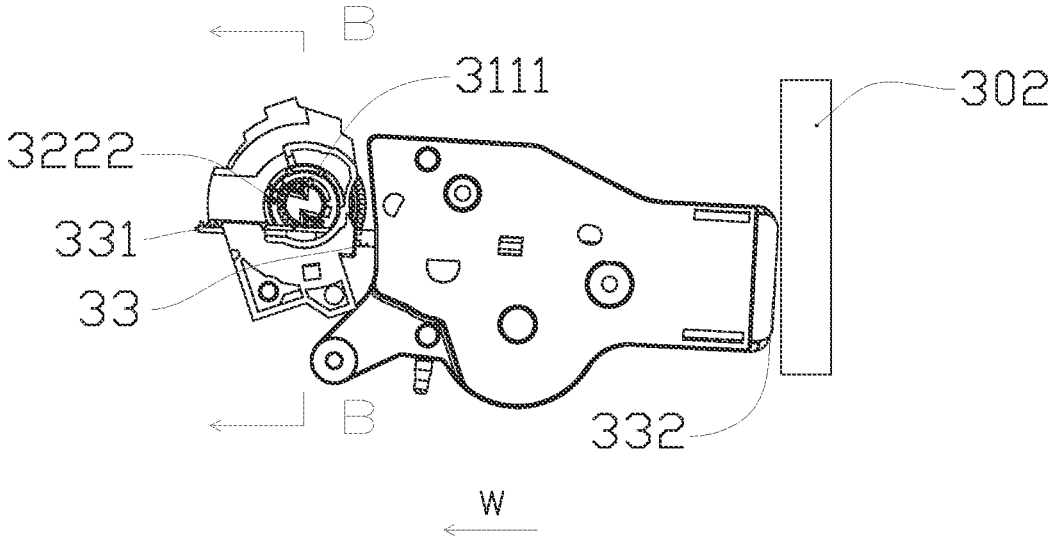
FIG. 11 is another schematic partial structural diagram of the process cartridge when the force receiving surface of the push rod of the process cartridge of the first embodiment is pressed by the door cover.
Figure 12:
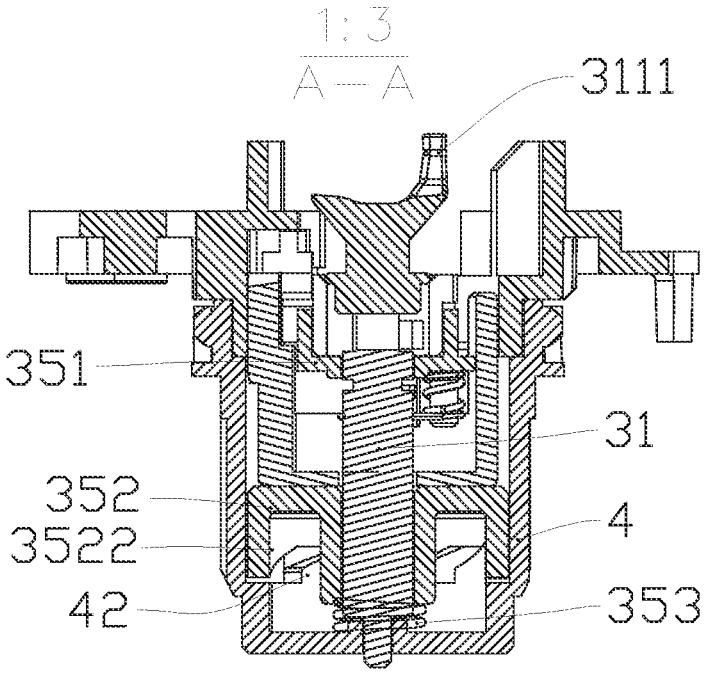
FIG. 12 is a cross-sectional view along a direction B-B shown in FIG. 11.

An installation process of the process cartridge 100 will be described hereafter with reference to FIG. 4, FIG. 7, FIG. 9, and FIG. 10. FIG. 7 is a schematic structural diagram illustrating the imaging device 300 and the process cartridge 100 when the door cover 302 of the imaging device 300 is not closed; FIG. 9 is a schematic partial structural diagram of the process cartridge 100 when the door cover 302 of the imaging device 300 is not closed, and when the push rod 33 of the process cartridge 100 is under no external force; FIG. 10 is a schematic partial structural diagram of the process cartridge 100 when the door cover 302 of the first embodiment is closed, and when the force receiving surface 332 of the push rod 33 is pressed by the door cover 302. A pressing block 3021 is disposed on the door cover 302 of the imaging device 300. When the process cartridge 100 is installed inside the chamber of the imaging device 300, the protruding claws 3111 of the process cartridge 100 are coupled with the output protrusions 3011 disposed on the side proximate to the imaging device 300; the door cover 302 is closed, and the pressing block 3021 on the door cover 302 presses against the force receiving surface 332 of push rod the 33; under the pushing force, the push rod 33 moves in the W direction. When the push rod 33 moves in the W direction, the force exerting member 331 on the push rod 33 meshes with the force receiving part 3222 on the cylindrical member 322 and drives the cylindrical member 322 to rotate in the a direction, and at this time the rotational force receiving member 31 does not rotates.

Figure 4:
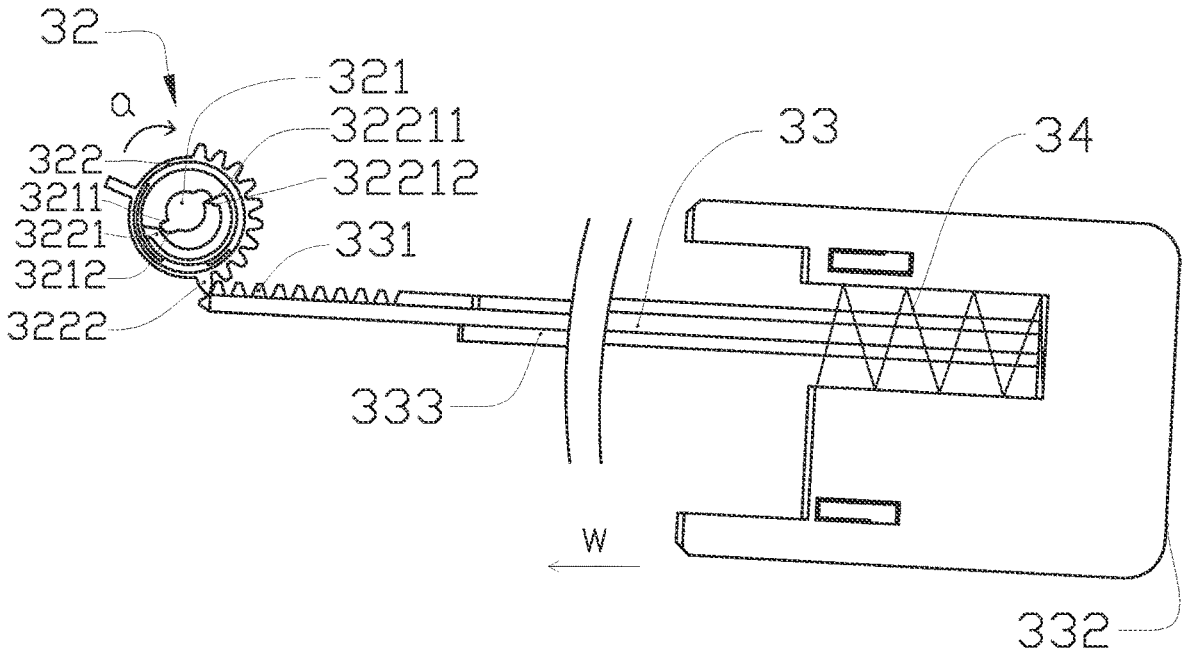
FIG. 4 is a schematic structural diagram of a position adjusting mechanism of the process cartridge of the first embodiment.
Figure 5:
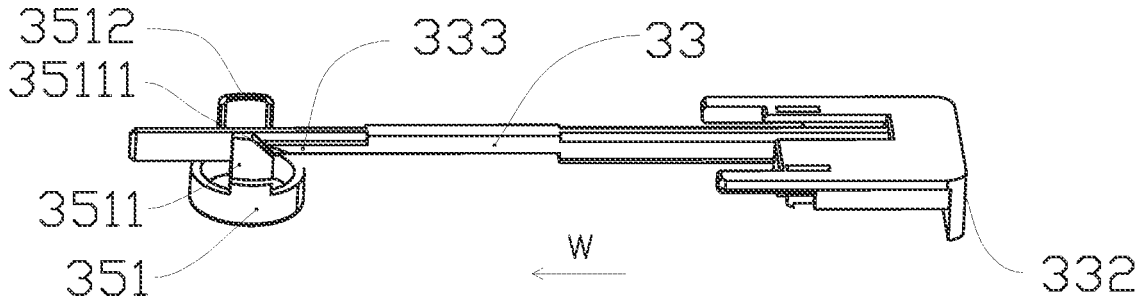
FIG. 5 is a schematic principle diagram of an interaction between a push rod and a clutch slide block of the process cartridge of the first embodiment.

Referring to FIGS. 3 to 5, and FIGS. 11 and 12, the movement of the push rod 33 forces the first protruding block 333 on the push rod 33 to press the sloping surface 35111 of the second protruding block 3511 on the clutch slide block 351, thus forcing the clutch slide block 351 to move towards the hub 4 along the L1-axis direction; simultaneously the clutch transmission member 352 is pressed, thus forcing the clutch transmission member 352 to move towards the hub 4, and making the second protruding part 3522 of the clutch transmission member 352 mesh with the first protruding part 42 on the hub 4. When the imaging device starts to work, the rotation of the rotational force output head 301 of the imaging device will drive the rotational force receiving member 31 to rotate, so that the protruding claws 3111 and the rotational force output head 301 are coupled together. Referring to FIGS. 3 and 4, when the process cartridge is in a working state, the rotational force receiving member 31 receives the rotational force from the rotational force output head 301 of the imaging device, and rotates in the direction opposite to the a direction. During the rotation of the rotational force receiving member 31, and while the second contact surface 3212 is in a sliding contact with the second end surface 32212, the second contact surface 3212 presses against the second end surface 32212, thus making the bracket elastically deform, and enabling the second contact surface 3212 to slide over the second end surface 32212. Then the rotational force receiving member 31 continues to rotate, but the cylindrical member 322 does not rotate.

The removal process of the process cartridge 100 will be described hereafter with reference to FIGS. 4 to 15*c*.

Figure 13A:
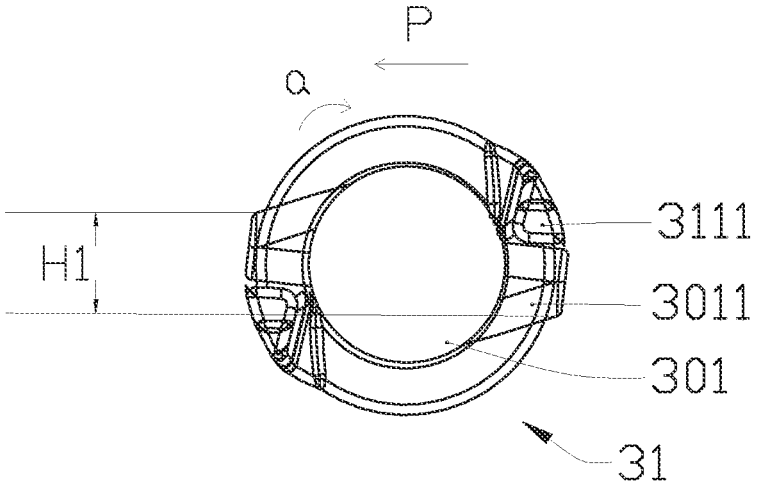
FIG. 13*a* is a schematic diagram illustrating an arbitrary positional relationship between output protrusions of the rotational force output head and two protruding claws symmetrically arranged on the rotational force receiving member when the imaging device of the first embodiment stops working.
Figure 13B:
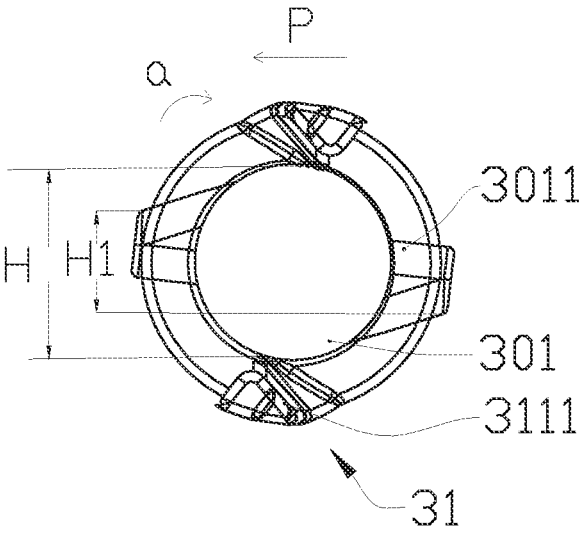
FIG. 13*b* is a schematic diagram illustrating a positional relationship between the output protrusions and the protruding claws after the rotational force receiving member of FIG. 13*a* of the first embodiment is adjusted by a position adjusting mechanism.

Referring to FIG. 13*b*, in this embodiment, the preset position of the rotational force receiving member 31 is preset to be such that when the rotational force receiving member 31 is located at the preset position, a line drawn between the two protruding claws 3111 of the rotational force receiving portion 311 is roughly perpendicular to a removal p direction of the process cartridge 100.

In this embodiment, when the door cover 302 is opened, the door cover 302 no longer presses the force receiving surface 332 disposed on the push rod 33, and the push rod 33, under the elastic force of the first coil spring 34, moves in the direction opposite to the W direction. When the push rod 33 moves in the direction opposite to the W direction, the first protruding block 333 on the push rod 33 is separated from the sloping surface 35111 of the second protruding block 3511 on the clutch slide block 351, and the clutch slide block 351 no longer presses the clutch transmission member 352. Under the elastic force of the second coil spring 353, the second protruding part 3522 of the clutch transmission member 352 is separated from the first protruding part 42 on the hub 4. As the push rod 33 continues to move along the direction opposite to the W direction, the force exerting member 331 on the push rod 33 meshes with the force receiving part 3222 of the cylindrical member 322, and the continuous movement of the push rod 33 in the direction opposite to the W direction will drive the cylindrical member 322 to rotate along the direction opposite to the a direction. Moreover, the bracket 3221 on the cylindrical member 322 drives the driven member 321 on the rotational force receiving member 31 to rotate together, thus forcing the rotational force receiving member 31 to rotate together towards the preset position in the direction opposite to the a direction.

When the imaging device stops working, the rotational force output head 301 and the rotational force receiving member 31 stop rotating and stop at random positions. However, after being adjusted by the position adjusting mechanism, the positions of the rotational force output head 301 and the rotational force receiving member 31 can be basically classified into three cases.

It is assumed that the direction shown by an arrow p is the removal direction of the process cartridge; H1 denotes the maximum distance along the removal direction p of the process cartridge and between projections of ends of the two output protrusions 3011 symmetrically arranged on the rotational force output head 301; and H denotes the minimum distance along the removal direction p of the process cartridge and between projections of two closest points between the two protruding claws 3111 symmetrically arranged on the rotational force receiving member 31 when the rotational force receiving member 31 is located at the preset position.

Figure 13C:
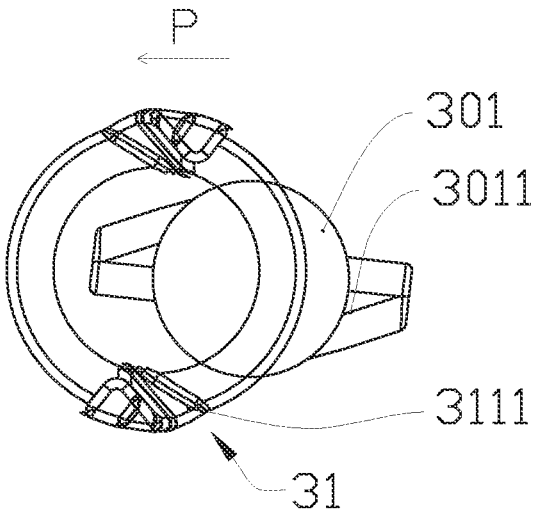
FIG. 13*c* is a schematic diagram illustrating the rotational force receiving member of FIG. 13*b* of the first embodiment breaking away from interference of the rotational force output head.

FIG. 13*a* is a schematic diagram illustrating an arbitrary positional relationship between the output protrusions 3011 of the rotational force output head and the two protruding claws 3111 symmetrically arranged on the rotational force receiving member 31 when the imaging device stops working. In this case, if the process cartridge is directly removed, there will be interference therebetween in the removal direction, which will cause wear of the output protrusions 3011 and the protruding claws 3111. FIG. 13*b* is a schematic diagram illustrating the positional relationship between the output protrusions 3011 and the protruding claws 3111 after a position adjustment is performed by the position adjusting mechanism. As shown in FIG. 13*b*, the rotational force output head 301 cannot rotate, however, when the door cover 302 is opened, by means of the adjustment of the position adjusting mechanism, the rotational force receiving member 31 rotates to the preset position in the direction opposite to the a direction. At this time, H1<H, and in the removal p direction of the process cartridge, there is no interference between the protruding claws 3111 and the output protrusions 3011. Referring to FIG. 13*c*, the process cartridge can be removed from the imaging device smoothly.

Figure 14A:
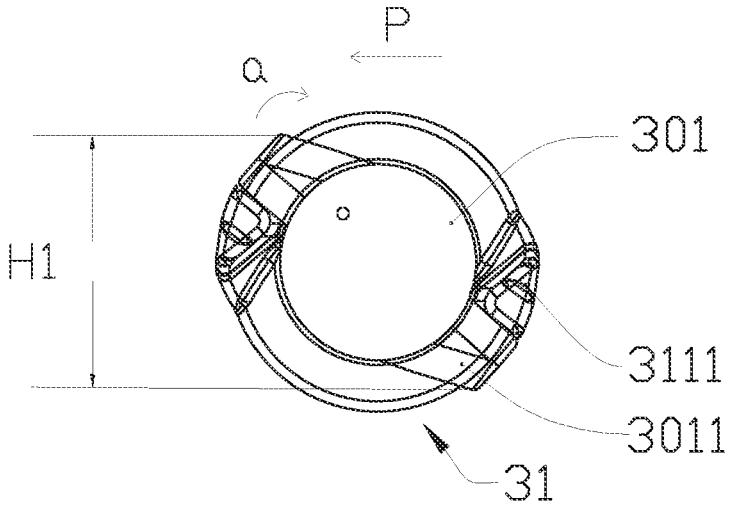
FIG. 14*a* is a schematic diagram illustrating another arbitrary positional relationship between the output protrusions of the rotational force output head and the two protruding claws symmetrically arranged on the rotational force receiving member when the imaging device of the first embodiment stops working.
Figure 14B:
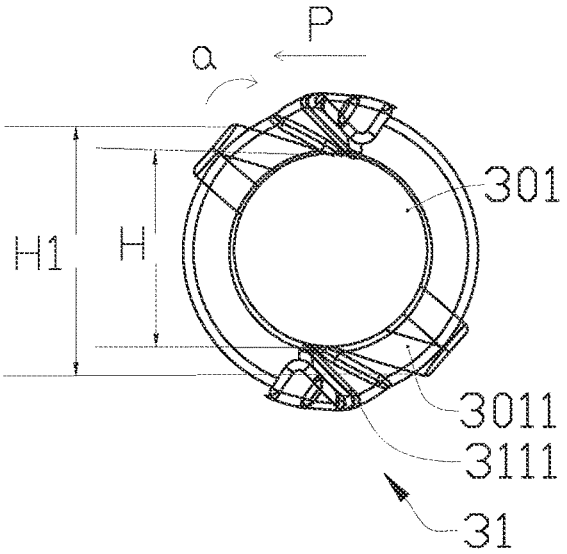
FIG. 14*b* is a schematic diagram illustrating a positional relationship between the output protrusions and the protruding claws after the rotational force receiving member of FIG. 14*a* of the first embodiment is adjusted by the position adjusting mechanism.
Figure 14C:
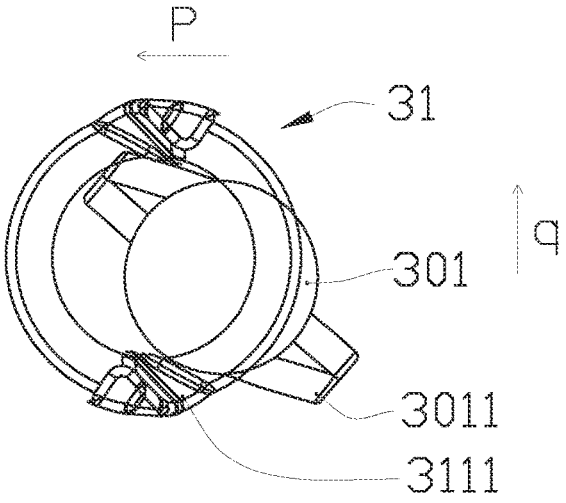
FIG. 14*c* is a schematic diagram illustrating the rotational force receiving member of FIG. 14*b* of the first embodiment breaking away from the interference of the rotational force output head.

FIG. 14*a* is a schematic diagram illustrating another arbitrary positional relationship between the output protrusions 3011 of the rotational force output head and the two protruding claws 3111 symmetrically arranged on the rotational force receiving member 31 when the imaging device stops working. In this case, if the process cartridge is removed directly, there will be interference therebetween in the removal direction, which will cause the wear of the output protrusions 3011 and the protruding claws 3111. FIG. 14*b* is a schematic diagram illustrating a positional relationship between the output protrusions 3011 and protruding claws 3111 after an adjustment is performed by the position adjusting mechanism. As shown in FIG. 14*b*, by means of the adjustment of the position adjustment device, the rotational force receiving member 31 rotates to the preset position in the direction opposite to the a direction. In this case, although H1>H, there will be certain interference between the protruding claws 3111 and the output protrusions 3011. However, there is space allowing a free movement of the process cartridge received inside the chamber of the imaging device in a q direction that is roughly perpendicular to the removal p direction of the process cartridge, thereby enabling the process cartridge to move in the q direction. Referring to FIG. 14*c*, in this case, if only the process cartridge is moved slightly, it can be removed from the imaging device smoothly.

Figure 15A:
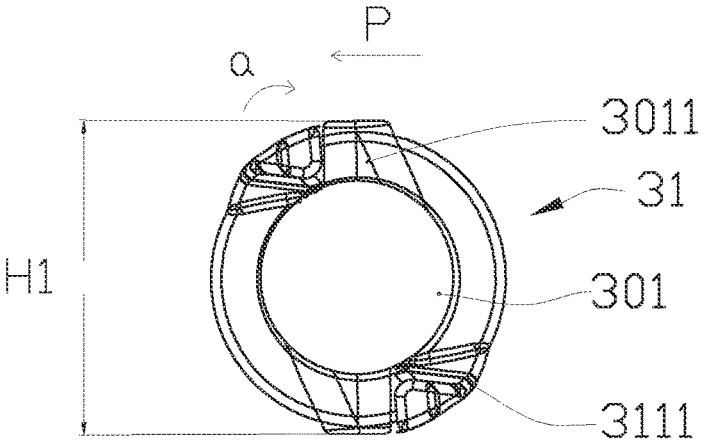
FIG. 15*a* is a schematic diagram illustrating a positional relationship between the output protrusions of the rotational force output head and the two protruding claws symmetrically arranged on the rotational force receiving member when, after the imaging device stops rotating, the output protrusions of the rotational force output head are located at a preset position of the rotational force receiving member.
Figure 15B:
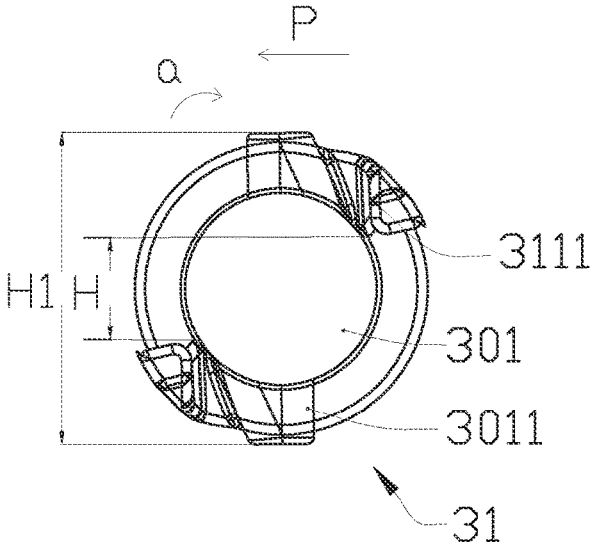
FIG. 15*b* is a schematic diagram illustrating a positional relationship between the output protrusions and the protruding claws after the rotational force receiving member of FIG. 15*a* of the first embodiment is adjusted by the position adjusting mechanism.
Figure 15C:
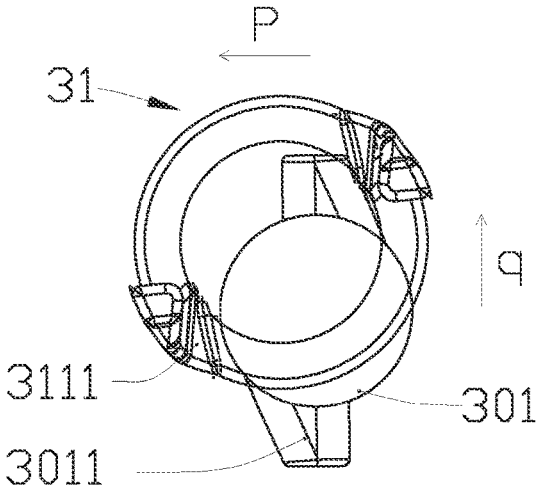
FIG. 15*c* is a schematic diagram illustrating the rotational force receiving member of FIG. 15*b* of the first embodiment breaking away from the interference of the rotational force output head.

FIG. 15*a* is a schematic diagram illustrating a positional relationship between the output protrusions 3011 of the rotational force output head 301 and the two protruding claws 3111 symmetrically arranged on the rotational force receiving member 31, when the imaging device stops working, and when the output protrusions 3011 of the rotational force output head 301 are located at the preset position of the rotational force receiving member 31. In this case, if the process cartridge is removed directly, there will be interference therebetween in the removal direction, which will cause wear of the output protrusions 3011 and the protruding claws 3111. FIG. 15*b* is a schematic diagram illustrating a positional relationship between the output protrusions 3011 and the protruding claws 3111 after an adjustment is performed by the position adjusting mechanism. As shown in FIG. 15*b*, by means of the adjustment of the position adjusting device, the protruding claws 3111 on the rotational force receiving member 31 rotates in the direction opposite to the a direction till they are obstructed by the output protrusions 3011. In this case, the rotational force receiving member cannot rotate to the preset position, but to a position closest to the preset position. In this case, since H1>H, there will be certain interference between the protruding claws 3111 and the output protrusions 3011 during the removal of the developing cartridge. However, there is space allowing a free movement of the process cartridge received inside the chamber of the imaging device in the q direction that is roughly perpendicular to the removal p direction of the process cartridge, thereby enabling the process cartridge to move in the q direction. Referring to FIG. 15*c*, in this case, if only the process cartridge is moved slightly, it can be removed from the imaging device smoothly.

Second Embodiment

A structure of the process cartridge of the second embodiment is basically the same as the process cartridge 100 of the first embodiment, and the differences therebetween are that the structures of the force receiving members and the force exerting members of the cylindrical members of two embodiments are different respectively.

Figure 16:
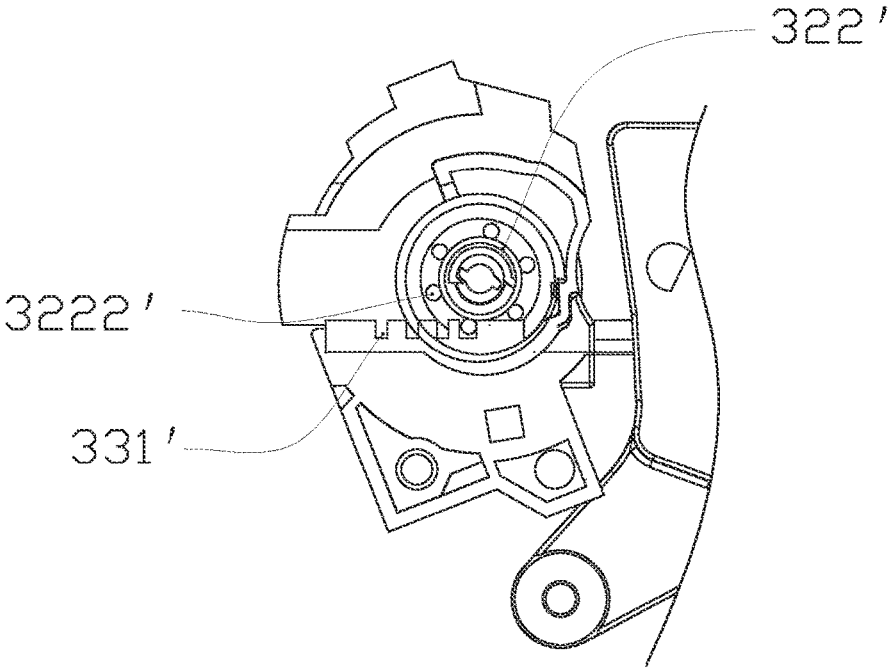
FIG. 16 is a schematic partial structural diagram of the process cartridge of a second embodiment.

As shown in FIG. 16, a force receiving part 3222' is arranged on a circumferential outer wall of the cylindrical member 322'. In this embodiment, the force receiving part 3222' includes a plurality of cams, which are distributed on the outer wall of the cylindrical member 322' of a whole circle along a circumferential direction. The force exerting member 331' includes grooves meshing with the force receiving part 3222'.

Finally, it should be noted that, the foregoing embodiments are merely some embodiments of the present disclosure, but not intended to limit the present disclosure. For those skilled in the art, various changes and modifications can be made for the present disclosure: the rotation component can be the developing roller, the powder feeding roller or the charging roller; the driving force receiving assembly can be installed at an end of any rotation component; the driving force receiving assembly may also not include the hub, the clutch component, etc. Any modification, equivalent replacement, and improvement, etc., made within the spirit and the principle of the present disclosure, shall be within the protection scope of the present disclosure.

What is claimed is:

1. A process cartridge, removably disposed in an imaging device, wherein the imaging device is provided with a rotational force output head and a door cover, and the process cartridge comprises:

a cartridge body;

a rotation component having a rotation axis;

a driving force receiving assembly disposed at an end of the cartridge body;

the driving force receiving assembly comprises:

a rotational force receiving member, provided with a rotational force receiving portion, a connecting portion, and a rotational force transmitting portion; and a position adjusting mechanism; wherein:

the position adjusting mechanism comprises a driven member disposed on the connecting portion of the rotational force receiving member, and an operating assembly configured to exert a force on the driven member and force the rotational force receiving member to rotate to a preset position;

the position adjusting mechanism enables the rotational force receiving member to rotate to the preset position when the door cover is opened;

the driven member comprises at least one rib disposed on the connecting portion, and the rib has a first contact surface and an arc-shaped second contact surface; and the preset position of the rotational force receiving member is preset to be such that when the rotational force receiving member is located at the preset position, a line drawn between two protruding claws of the rotational force receiving portion is substantially perpendicular to a removal direction of the process cartridge.

2. The process cartridge according to claim 1, wherein the operating assembly comprises a cylindrical member sleeved over an outer side of the rotational force receiving member; at least one bracket is provided on an inner side wall of the cylindrical member; and at least one force receiving part is provided on an outer side wall of the cylindrical member.

3. The process cartridge according to claim 2, wherein the bracket is an elastic arm extending from the inner side wall of the cylindrical member in a radial direction towards an axis of the cylindrical member; a free end of the bracket has a first end surface capable of abutting against the first contact surface and a second end surface capable of being in a sliding contact with the second contact surface.

4. The process cartridge according to claim 2, wherein the operating assembly further comprises a force exerting member, and the force exerting member is configured to exert a rotational force on the force receiving part to force the cylindrical member to rotate.

5. The process cartridge according to claim 4, wherein the driving force receiving assembly further comprises a push rod, and the force exerting member is arranged at an end of the push rod.

6. The process cartridge according to claim 5, wherein the force receiving part comprises at least one first protrusion or first groove provided on an outer circumferential wall of the cylindrical member; and the force exerting member comprises a second groove meshing with the first protrusion, or a second protrusion meshing with the first groove.

7. The process cartridge according to claim 6, wherein the process cartridge further comprises:

an end cover disposed at an end of the cartridge body;

a hub arranged at an end of the rotation component, the hub having a chamber provided with a first protruding part therein; and a bearing plate disposed at an end of the cartridge body, wherein a first protruding pillar and a second protruding pillar are disposed on a side of the bearing plate facing the hub, and the rotational force receiving member is capable of passing through a bearing orifice of the bearing plate and being coupled with the rotational force output head.

8. The process cartridge according to claim 5, wherein the force receiving part and the force exerting member are both tooth-shaped and capable of meshing with each other.

9. The process cartridge according to claim 7, wherein the process cartridge further comprises:

an end cover disposed at an end of the cartridge body;

a hub arranged at an end of the rotation component, the hub having a chamber provided with a first protruding part therein; and a bearing plate disposed at an end of the cartridge body, wherein a first protruding pillar and a second protruding pillar are disposed on a side of the bearing plate facing the hub, and the rotational force receiving member is capable of passing through a bearing orifice of the bearing plate and being coupled with the rotational force output head.

10. The process cartridge according to claim 5, wherein the process cartridge further comprises:

an end cover disposed at an end of the cartridge body;

a hub arranged at an end of the rotation component, the hub having a chamber provided with a first protruding part therein; and a bearing plate disposed at an end of the cartridge body, wherein a first protruding pillar and a second protruding pillar are disposed on a side of the bearing plate facing the hub, and the rotational force receiving member is capable of passing through a bearing orifice of the bearing plate and being coupled with the rotational force output head.

11. The process cartridge according to claim 10, wherein the rotation component is a photosensitive drum or a developing roller.

12. The process cartridge according to claim 10, wherein the driving force receiving assembly further comprises:

a first coil spring sleeved on the push rod to exert an elastic force on the push rod;

a clutch component comprising a clutch slide block, a clutch transmission member, and a second coil spring, wherein the second coil spring is disposed between the clutch transmission member and the hub; and two biasing springs arranged on the first protruding pillar and the second protruding pillar respectively, wherein a first free end of each biasing spring is pressed against a side surface of the rotational force receiving member; a second free end of one biasing spring is pressed against the first protruding pillar, and a second free end of another biasing spring is pressed against the second protruding pillar.

13. The process cartridge according to claim 12, wherein the bearing plate defines at least one second through orifice;

the clutch slide block is provided with at least one second protruding block; the second protruding block is provided with a sloping surface; the second protruding block is capable of passing through the second through orifice;

the push rod is provided with a first protruding block and a force receiving surface, and the first protruding block is capable of abutting against the sloping surface;

the end cover defines a first through orifice; and an end of the push rod is capable of passing through the first through orifice and moving relative to the first through orifice.

14. The process cartridge according to claim 12, wherein the clutch transmission member is further provided with a second protruding part, and the second protruding part meshes with the first protruding part of the hub in an L1-axis direction to transmit a rotational force to the hub.

* * * * *